US007510512B1

(12) United States Patent
Taggett

(10) Patent No.: US 7,510,512 B1
(45) Date of Patent: Mar. 31, 2009

(54) EXERCISE MACHINE

(76) Inventor: Michael Blake Taggett, 2027 W. Carroll St., Chicago, IL (US) 60612

( * ) Notice: Subject to any disclaimer, the term of this patent is extended or adjusted under 35 U.S.C. 154(b) by 693 days.

(21) Appl. No.: 11/003,056

(22) Filed: Dec. 3, 2004

Related U.S. Application Data

(60) Provisional application No. 60/526,913, filed on Dec. 4, 2003.

(51) Int. Cl.
*A63B 22/12* (2006.01)

(52) U.S. Cl. ..... 482/62; 482/111

(58) Field of Classification Search ..... 482/5, 482/51–52, 55–59, 62, 63, 70, 71, 79, 80, 482/110, 111, 113, 148, 53; 601/33, 34, 601/35, 36

See application file for complete search history.

(56) References Cited

U.S. PATENT DOCUMENTS

| | | | | |
|---|---|---|---|---|
| 326,247 | A | 9/1885 | Root | |
| 2,630,332 | A | 3/1953 | Pettijohn | |
| 3,017,180 | A | 1/1962 | Aronsohn | |
| 3,572,699 | A * | 3/1971 | Nies | 482/5 |
| 3,964,742 | A * | 6/1976 | Carnielli | 482/7 |
| 4,222,376 | A * | 9/1980 | Praprotnik | 601/24 |
| 4,436,097 | A * | 3/1984 | Cunningham | 600/520 |
| 4,688,791 | A | 8/1987 | Long | |
| 4,705,269 | A * | 11/1987 | DeBoer et al. | 482/62 |
| 4,880,225 | A | 11/1989 | Lucas et al. | |
| 4,902,002 | A | 2/1990 | Huang | |
| 4,934,690 | A | 6/1990 | Bull | |
| 4,948,119 | A | 8/1990 | Robertson, Jr. | |
| 5,040,785 | A | 8/1991 | Charnitski | |
| 5,048,824 | A * | 9/1991 | Chen | 482/2 |
| 5,328,422 | A * | 7/1994 | Nichols | 482/52 |
| 5,330,402 | A * | 7/1994 | Johnson | 482/62 |
| 5,338,272 | A * | 8/1994 | Sweeney, III | 482/57 |
| 5,378,209 | A | 1/1995 | Kendrew | |
| 5,492,518 | A | 2/1996 | Measom | |
| 5,575,739 | A | 11/1996 | Piaget et al. | |
| 5,584,782 | A | 12/1996 | Szabo et al. | |
| 5,616,106 | A | 4/1997 | Abelbeck | |
| 5,669,865 | A | 9/1997 | Gordon | |
| 5,709,633 | A | 1/1998 | Sokol | |
| 5,735,778 | A | 4/1998 | Piaget | |
| 5,816,983 | A | 10/1998 | Dawes et al. | |
| 5,836,859 | A | 11/1998 | Van Herle | |
| 5,906,563 | A | 5/1999 | Pittari | |
| 6,135,923 | A | 10/2000 | Stearns et al. | |
| 6,533,708 | B2 | 3/2003 | Taggett | |
| 6,960,155 | B2 * | 11/2005 | Chien et al. | 482/62 |

FOREIGN PATENT DOCUMENTS

| | | |
|---|---|---|
| CH | 613120 A5 | 9/1979 |

* cited by examiner

*Primary Examiner*—Loan H Thanh
*Assistant Examiner*—Tam Nguyen
(74) *Attorney, Agent, or Firm*—Robert O. Blinn

(57) ABSTRACT

The present exercise machine includes a frame, a seat, foot pedals, a resistance device and a hand crank assembly. The resistance device includes a rotating element such as a cylindrical fan which would require a power input in order to continue rotating. The hand crank assembly is pivotably mounted to the frame such that the hand crank assembly can quickly pivot between a first position suitable for a seated operator and a second position suitable for an upright operator.

7 Claims, 6 Drawing Sheets

EXERCISE MACHINE

CROSS REFERENCE TO RELATED APPLICATION

This application claims the benefit of U.S. provisional application 60/526,913 filed Dec. 4, 2003.

FIELD OF THE INVENTION

This invention relates to an exercise machine.

BACKGROUND OF THE INVENTION

The prior art teaches various exercise machines for exercising the legs and arms. Yet, there still exists a need for an exercise machine for exercising the legs and arms which also allows an operator to move between a seated position and a standing position while continuing to exercise. Still further, a need exists for an exercise machine which automatically shifts to a higher resistance mode when the operator moves into an upright position.

BRIEF DESCRIPTION OF THE INVENTION

In an embodiment of the present invention the aforementioned needs are addressed by an exercise machine including a conventional bicycle seat, a pair of opposed foot pedals, a hand crank assembly, a resistance device and a drive train operatively connecting the foot pedals, the hand crank assembly and the resistance device and a frame for supporting the seat, the foot pedals, the hand crank assembly, the resistance device and the drive train. The hand crank assembly includes a proximate end which is pivotably mounted to the frame and a distal end which carries a hand crank. The hand crank assembly may be pivoted by the operator between a first lower position wherein the hand crank is relatively close to the seat for access by a seated operator and a second raised position in which the hand crank is relatively higher and more distant from the seat for use by a standing operator. Moreover, the hand crank assembly may be operatively associated with the resistance device so that resistance changes when the position of the hand crank is changed.

The power train of the exercise machine is arranged to support the simultaneous and the separate operation of the foot pedals and the hand crank assembly. The power train is arranged so that the foot pedals and the hand cranks turn in the substantially the same direction, at substantially the same rate. Preferably, the power train is also arranged so that at least one single one-way clutch is interposed between the power train and the resistance device, so that a resistance device such as a fan can continue to turn if the operator stops moving the hand foot pedals and the hand cranks. Still more preferably, the power train may be arranged such that one-way clutches are interposed between the foot pedals and the resistance device and between the hand crank and the resistance device so that either the hand crank or the foot pedals may be operated separately while the other is not moving.

DETAILED DESCRIPTION OF THE INVENTION

Figure 1:
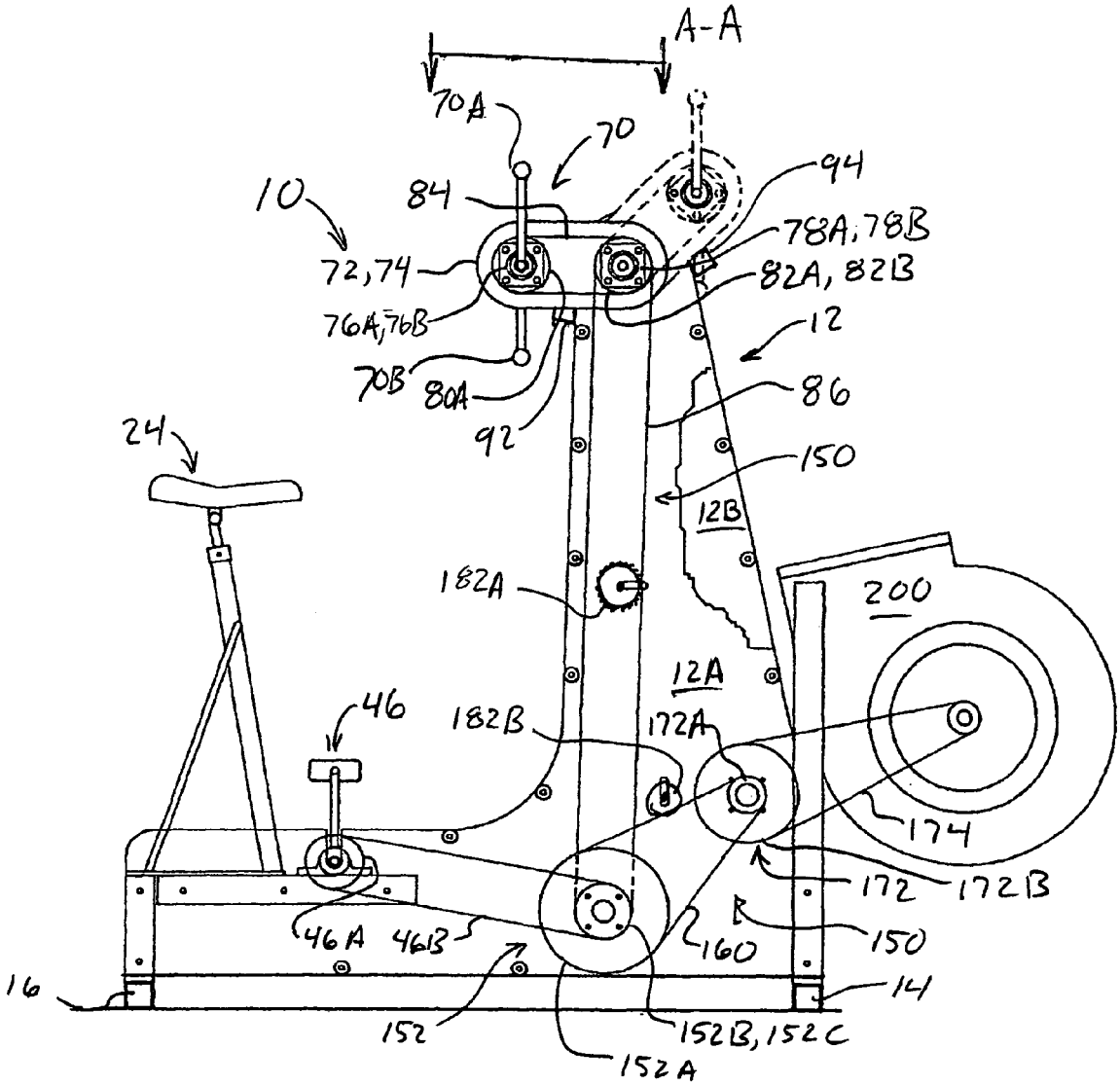
FIG. 1 is a side view of the exercise machine of the present invention.

Referring to the drawings, FIG. 1 illustrates exercise machine 10 as including a frame 12, a seat 24, a foot pedal assembly 46, a hand crank assembly 70, a power train 150 and a resistance device 200. Frame 12 includes two substantially symmetric side plates 12A and 12B which are spaced to enclose many of the various mechanical components of exercise machine 10. Side plate 12A is positioned behind most of the mechanical components shown in FIGS. 1-5 while side plate 12B is mostly cut away to reveal the various mechanical components of exercise machine 10. Transverse legs 14 and 16 are fixed to the front and back ends of frame 12 to provide lateral support. As can be seen in FIG. 1, seat 24 and foot pedal assembly 46 are like those typically found on a bicycle or exercise cycle and are also positioned relative to each other as they would be with a bicycle or an exercise cycle. Seat 24, as with a typical bicycle seat, may be adjusted for height and angle. Foot pedal assembly 46 is operatively interconnected to power train 150 through a standard one-way clutch so that foot pedal assembly 46 may remain stationary while other portions of the machine are rotating.

Figure 2:
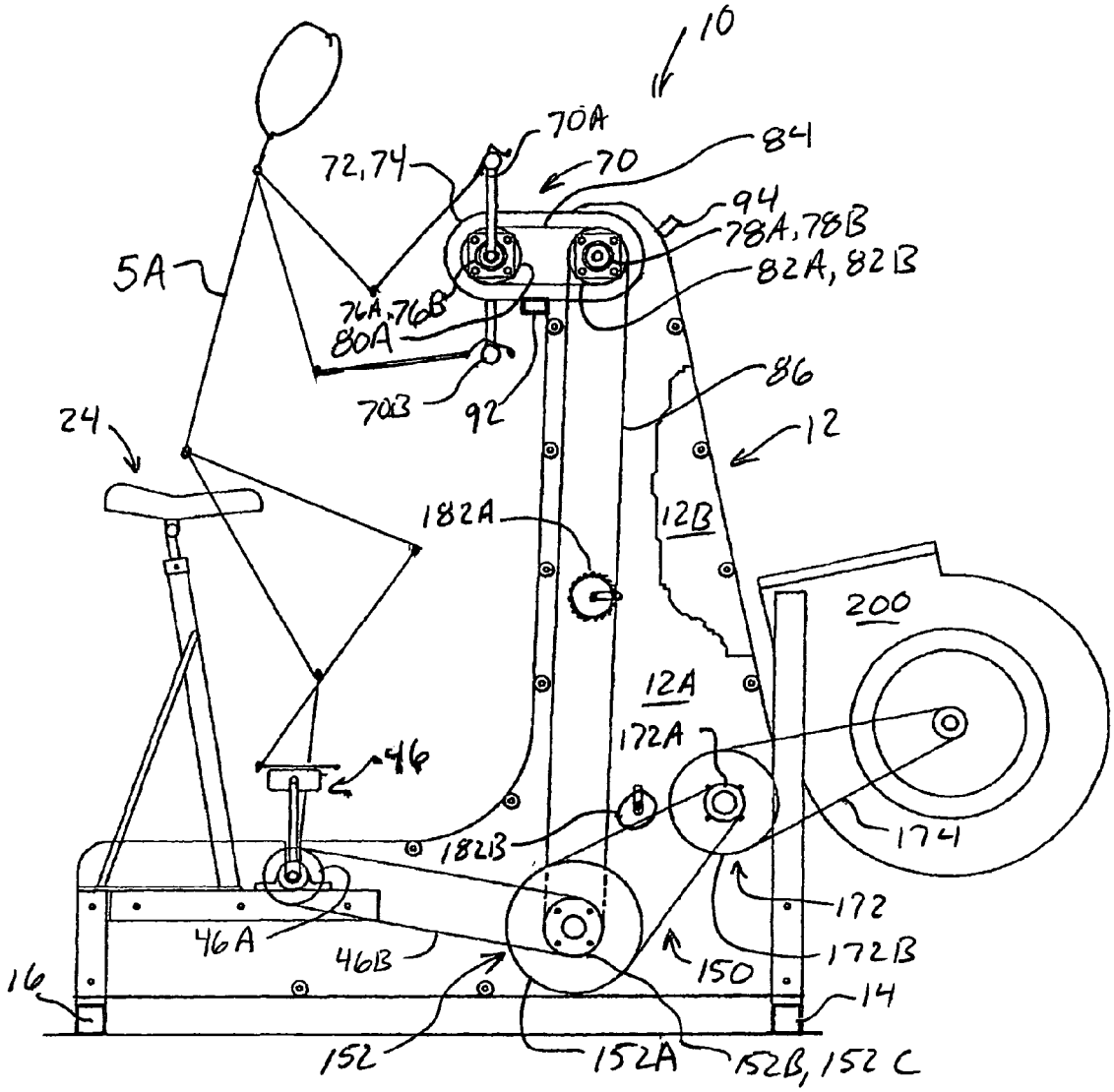
FIG. 2 is a side view of the exercise machine of the present invention shown with an operator in a seated position.

Hand crank assembly 70 is designed for use in a first position and second position. The first position is shown with solid lines in FIG. 1 and in FIG. 2 while the second position is shown with dashed lines in FIG. 1 and with solid lines in FIG. 3. When hand crank assembly 70 is in the first position, as shown in FIG. 2, its handles may be reached by an operator 5 sitting on seat assembly 24. When hand crank assembly 70 is in the second position, as shown in FIG. 3, its handles may be best reached by an operator 5 who is in an upright, high power output position.

Figure 1A:
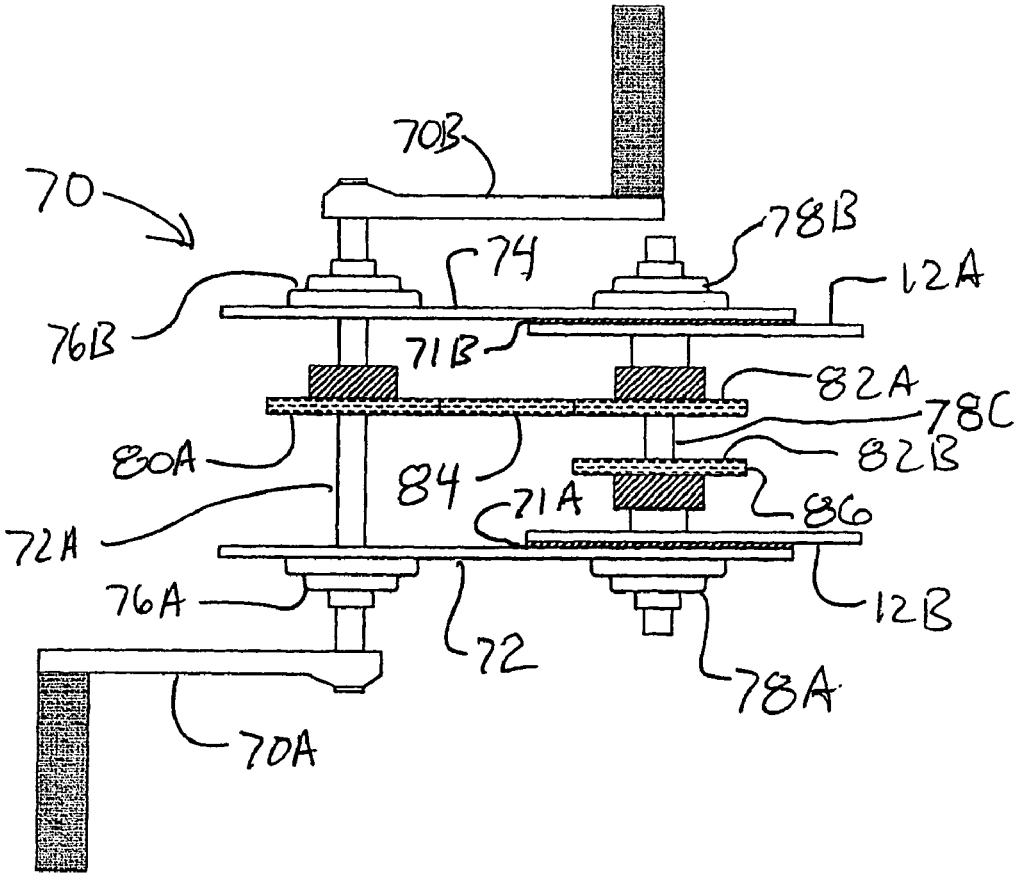
FIG. 1A is a top view of the hand crank assembly taken from plane A-A of FIG. 1.

Hand crank assembly 70 can be best understood by referring to FIGS. 1 and 1A. Hand crank assembly 70 fits around plates 12A and 12B of frame 12 and includes two side plates 72 and 74 which are held in a spaced relationship by a bearings 76A, 76B mounted on shaft 72A and bearings 78A and 78B mounted on shaft 78C. Shaft 72A carries a hand crank sprocket 80A and a pair of opposed hand cranks 70A and 70B. Shaft 78C which is at the opposite, proximate end of hand crank assembly 70 carries a first sprocket 82A and a second sprocket 82B. First sprocket 82A and hand crank sprocket 80A are connected by a chain 84. Second sprocket 82B and the remainder of power train 150 are connected by chain 86. Nylon spacers 71A and 71B for assuring a smooth pivoting motion of hand crank assembly 70 are interposed between side plates 72 and 74 and plates 12A and 12B of frame 12. Hand crank assembly 70 pivots about shaft 78C between the first lower position shown in FIG. 2 and the second raised position shown in FIG. 3. Stops 92 and 94 are mounted to frame 12 to limit the movement of hand crank assembly 70 between those two positions.

As can be seen in FIG. 2, the first lower position of hand crank assembly 70 is suitable for manipulation for seated operator 5A. When in the first lower position, hand cranks 70A and 70B are relatively low and relatively close to seat 24.

Figure 3:
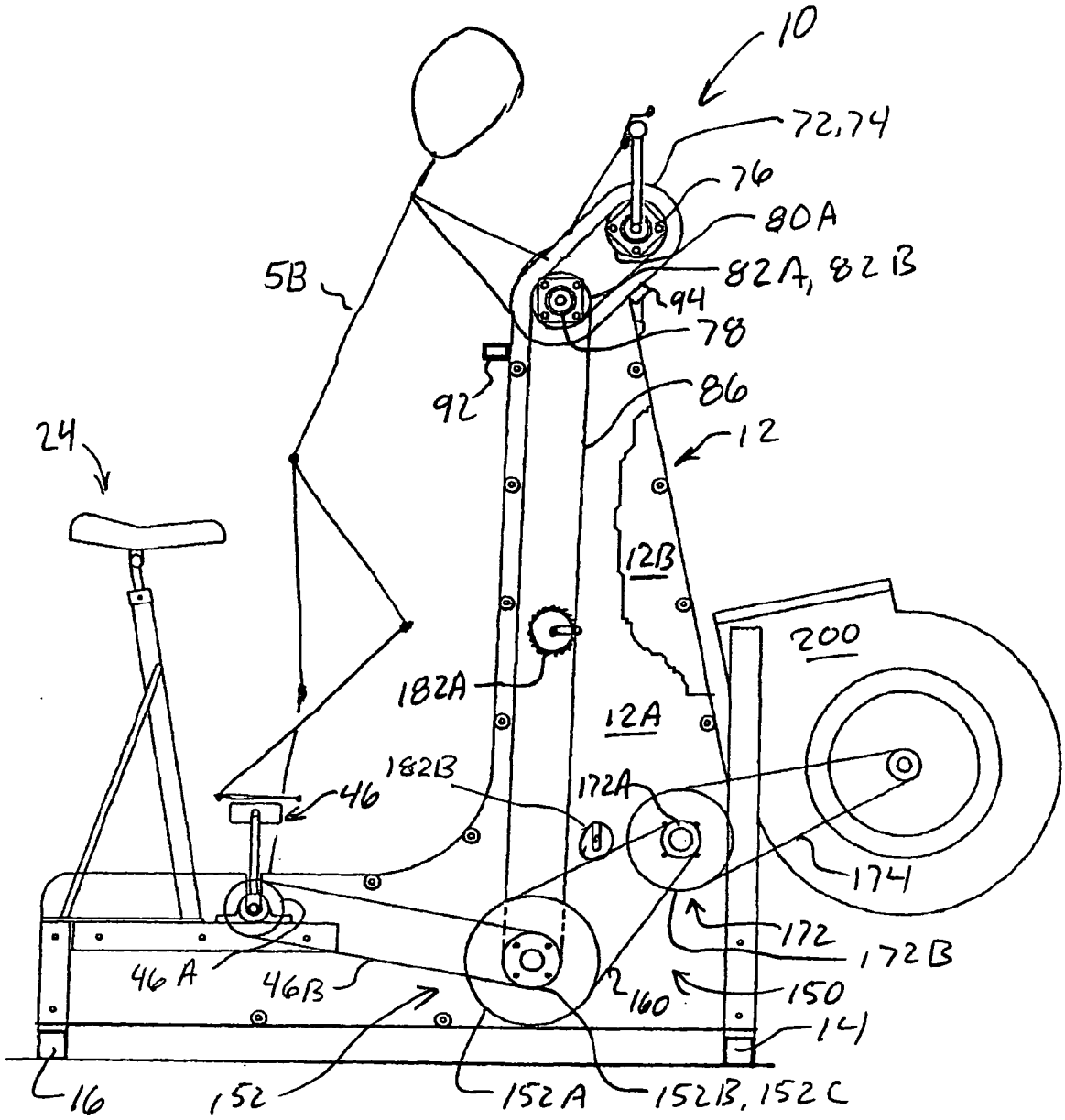
FIG. 3 is a side view of the exercise machine of the present invention shown with an operator in a standing position.

As can be seen in FIG. 3, the second raised position of hand crank assembly 70 is suitable for manipulation by a standing or upright operator 5B. When in the second raised position, hand cranks 70A and 70B are relatively high and relatively far from seat 24.

Figure 4:
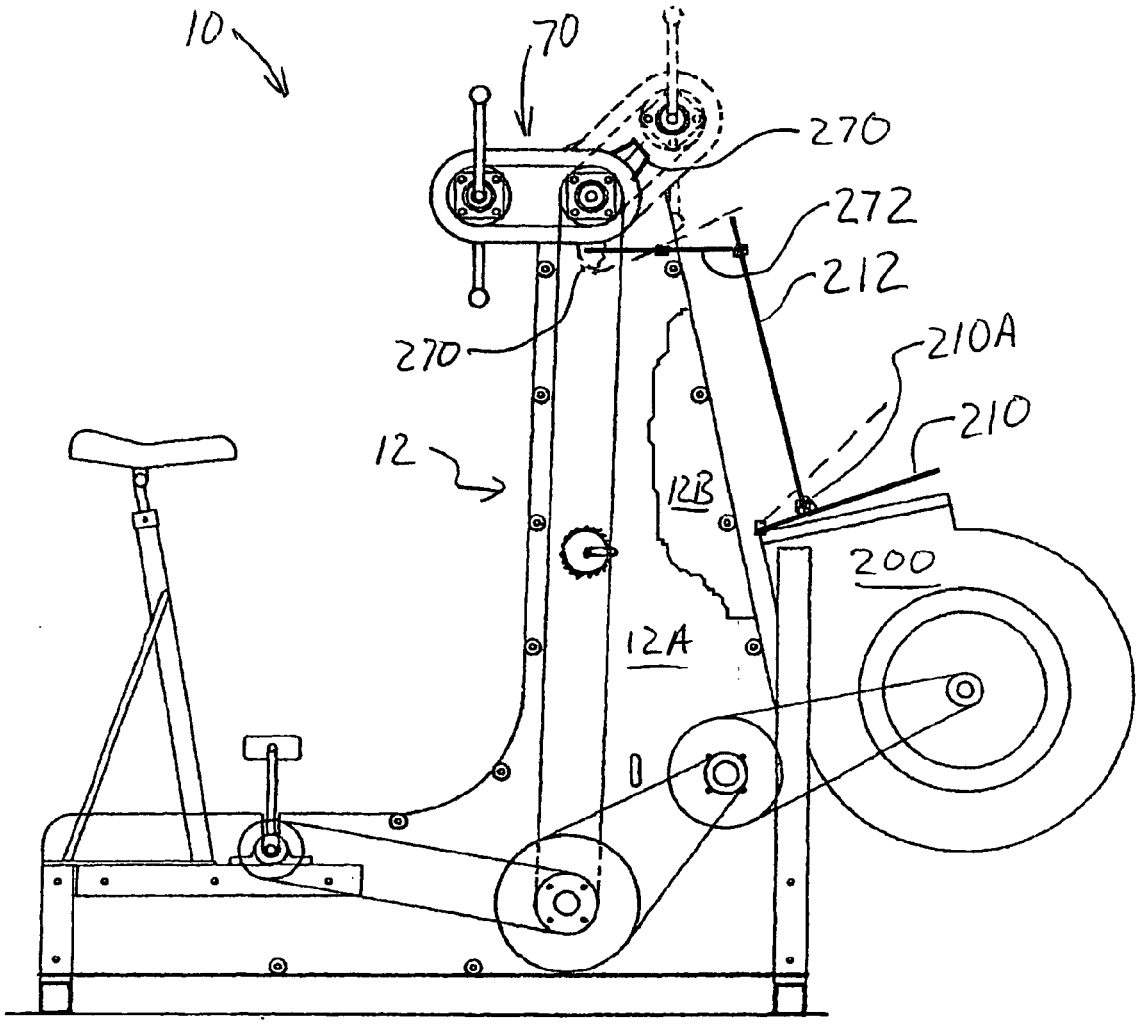
FIG. 4 is a side view of the exercise machine of the present invention shown with a first optional mechanism for changing the resistance of the resistance device in response to changing the position of the hand crank assembly.

FIG. 4 is a side view of the exercise machine of the present invention shown with a first optional mechanism for changing the resistance of the resistance device in response to changing the position of the hand crank assembly. Power train 150 transfers power from foot pedal assembly 46 to resistance device 200 and from hand crank assembly 70 to resistance device 200. The gear ratios of power train 150 are preferably arranged such that the rotation rate of foot peddle assembly 46 and hand crank assembly 70 are substantially identical. However, these ratios may be set such that there is a significant difference between the rates of rotation of the foot pedal assembly 46 and hand crank assembly 70 as might be the case where rapid hand crank movement relative to slower foot pedal movement is desired.

Power train 150 includes a primary sprocket 152 assembly and a secondary sprocket assembly 172. Primary sprocket assembly 152 includes a main sprocket 152A, a right side sprocket 152B and a left side sprocket 152C. Right side sprocket 152 B receives an endless chain 46B from foot peddle assembly 46. Left side sprocket 152 C receives endless chain 86 from hand crank assembly 70. Secondary sprocket assembly 172 includes an input sprocket 172A and an output sprocket 172B. Input sprocket 172A is connected by endless chain 160 to main sprocket 152A of primary sprocket assembly 152 and output sprocket 172B is connected by endless chain 174 to resistance device 200. Adjustable idler sprockets 182A and 182B are for maintaining adequate tension in endless chains 86 and 160. Other adjustable idler sprockets may also be added to maintain adequate tension in the various chains of power train 150.

In this embodiment, resistance device 200 is a cylindrical fan. Numerous other rotating elements that resist turning could be selected other than cylindrical fan 200. For example, an electric generator could be selected. Simple friction devices such as belted flywheel could be employed. Preferably, the resisting element should present resistance that increases with speed. By examining the diameters of the various sprockets of power train 150, the skilled reader can see that there is an increasing ratio of approximately one to ten between the speed of rotation of foot peddle assembly 46 or hand crank assembly 70 and the fan of resistance device 200. These ratios may vary considerably depending on the type of resistance device selected.

Power train 150 preferably includes at least a single one-way clutch at sprocket 152A or sprocket 172A or at the shaft of resistance device 200. Such a one-way clutch will allow resistance device 200 to continue turning even if no power is applied at either the foot pedals or the hand crank assembly. This is especially important if resistance device 200 includes a rotating fan. Additionally or in the alternative, one-way clutches may also be added to sprocket 46A and either sprocket 82A or sprocket 80A so that both the foot pedals and the hand crank assembly can be clutched independently. This would allow an operator to selectively rest either the foot pedals or the hand cranks thus allowing an operator to rotate foot peddle assembly 46 and hand crank assembly 70 either independently or simultaneously.

Although chains and sprockets may be used in power train 150, those skilled in the art will readily appreciate that belts and pulleys or belts and pulleys having corresponding teeth may replace some or all of the chain and sprocket elements noted above.

As noted above, hand crank assembly 70 and fan 200 may be operatively associated with each other so that changes in the position of hand crank assembly 70 causes a change in the resistance offered by fan 200. FIG. 4 illustrates one-way for operatively associating fan 200 and hand crank assembly 200. In FIG. 4, a cam 270 has been added to hand crank assembly 70 and a hamper 210 has been added to the outlet of fan 200. A pivot arm 272 has been mounted between side plates 12A and 12B of frame 12. A connecting rod 212 connects the end of pivot arm 272 to a pivot joint 210A mounted to hamper 210. Hamper 210 is in a normally partially open position. Because this restricts the amount of air that can flow through fan 200, this normally partially open position causes fan 200 to operate in a relatively low power setting. When hand crank assembly 70 is rotated into the phantom position shown in FIG. 4, cam 270 pushes down on pivotably mounted pivot arm 272 which in turn causes connecting rod 212 to pull up on hamper 210 thus opening up the outlet for fan 200. This causes fan 200 to be in a relatively high power setting so that it offers increased resistance to an operator. This is of course only an example of only one of many ways in which a resistance device may be operatively associated with the position of hand crank assembly 70 so that more power is required when hand crank assembly 70 is moved in to a high power position to accommodate an upright operator. It should also be noted that the joint between pivot arm 272 and connecting rod 212 may be adjustable so that both of the power settings can be adjusted as desired.

Figure 5:
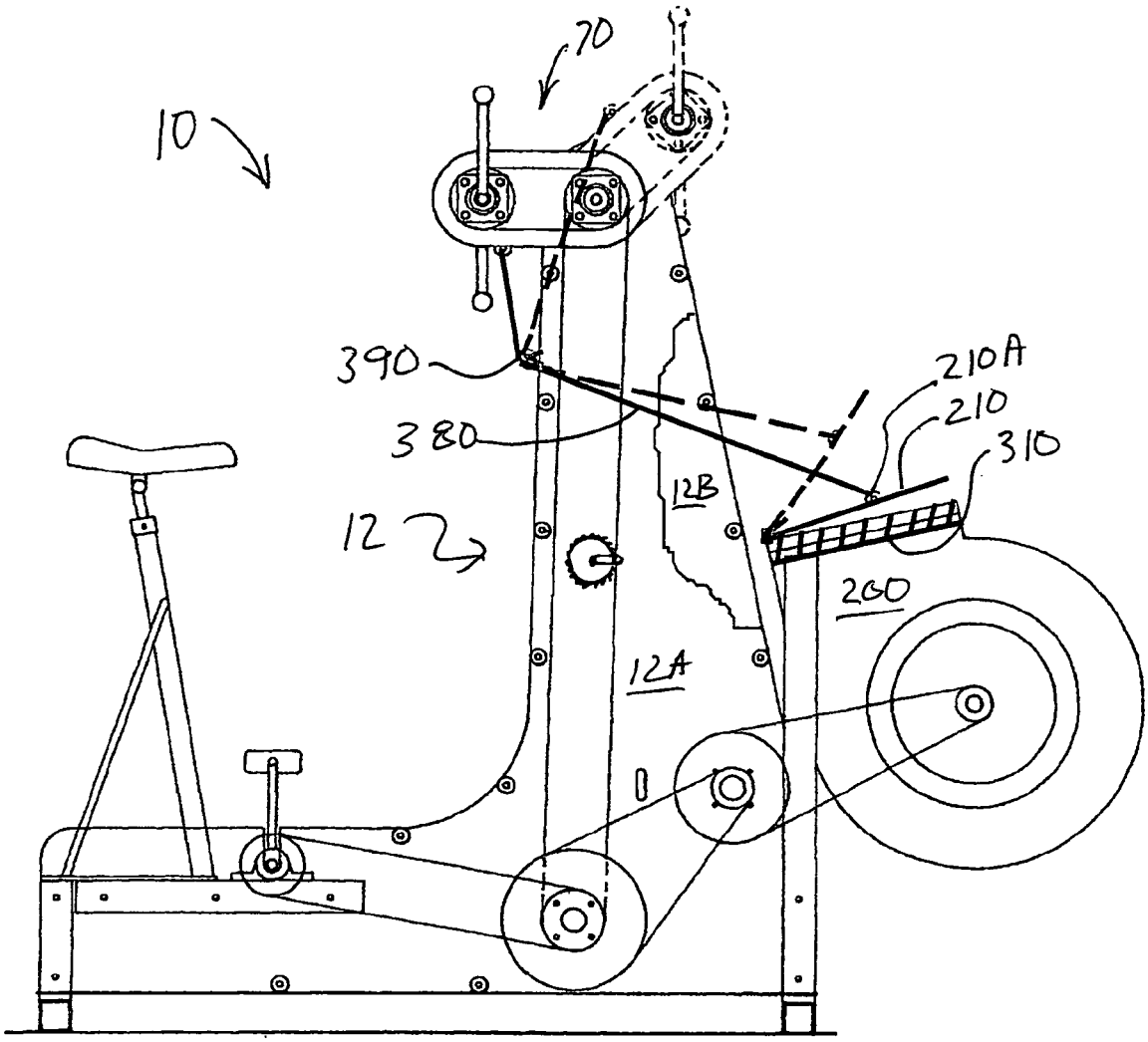
FIG. 5 is a side view of the exercise machine of the present invention shown with a second optional mechanism for changing the resistance of the resistance device in response to changing the position of the hand crank assembly.

By way of example, FIG. 5 illustrates a second mechanism for operatively associating the resistance offered by fan 200 and the position of hand crank assembly 70. In FIG. 5, a cable 380 connects between hamper 210 and hand crank assembly 70 via a pulley 390. As can be seen from the phantom illustration in FIG. 5, when hand crank assembly 70 is rotated into the second raised position, cable 380 pulls hamper 210 into an open position. When hamper 210 is in an open position more air may flow through fan 200 which increases the power demand offered by fan 200.

Exercise machine 10 shown in FIG. 5 also includes an air filter 310 mounted at the outlet of fan 200. Air filter 310 filters air exiting fan 200. If configured to provide air to the operator, filter 310 provides the added function of supplying clean filtered air to the operator.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. An exercise machine comprising:

a frame, a seat for supporting an operator, a pair of opposed foot pedals, a hand crank assembly including hand cranks and a resistance device mounted to said frame, said foot pedals, said band crank assembly and said resistance device operatively interconnected by a drive train, said hand crank assembly pivotably mounted to said frame for pivoting between a first lower position and a second raised position, the first lower position characterized by placement of said hand crank assembly in a generally horizontal position such that said hand crank assembly is directed toward said seat and such that said hand cranks are relatively lower and closer to said seat whereby a seated operator may more easily grasp said hand cranks, the second raised position characterized by placement of said hand crank assembly in an orientation directed away from said seat such that said hand cranks are higher than when in the first position and more distant from said seat than when in the first position whereby said hand cranks are in a position suitable for grasping by a standing operator, whereby an operator may pivot said hand crank assembly between the first lower position and the second raised position when changing between a seated position and a standing position, and, said hand crank assembly is operatively associated with said resistance device such that greater resistance is provided to the hand cranks when the hand crank assembly is in the second raised position and less resistance is provided to the hand cranks when the hand crank assembly is in the first lower position.

2. The exercise machine of claim 1 wherein:

the resistance device is a fan.

3. The exercise machine of claim 1 wherein:

the resistance device is a fan, and air flow through the fan is regulated by a hamper which can move between a relatively open position and a relatively closed position.

4. An exercise machine comprising:

a frame, a seat for supporting an operator, a pair of opposed foot pedals, a hand crank assembly including hand cranks and a resistance device mounted to said frame, said foot pedals, said hand crank assembly and said resistance device operatively interconnected by a drive train, said hand crank assembly pivotably mounted to said frame for pivoting between a first lower position and a second raised position, the first lower position characterized by placement of said hand crank assembly in a generally horizontal position such that said hand crank assembly is directed toward said seat such that said hand cranks are relatively lower and closer to said seat whereby a seated operator may more easily grasp said hand cranks, the second raised position characterized by placement of said hand crank assembly in an orientation directed away from said seat such that said hand cranks are higher than when in the first lower position and more distant from said seat than when in the first lower position whereby said hand crank is in a position suitable for grasping by a standing operator, whereby an operator may pivot said hand crank assembly between the first lower position and the second raised position and when changing between a seated position and a standing position, said resistance device is a fan, and air flow through the fan is regulated by a hamper which can move between a relatively open position and a relatively closed position, said hand crank assembly is operatively associated with said fan such that said hamper moves between said relatively open position and said relatively closed position when said hand crank moves between said first lower position and said second raised position.

5. The exercise machine of claim 4 wherein:

said hand crank assembly is operatively associated with said fan such that said hamper is in said relatively open position when said hand crank is in the second raised position and such that said hamper is in said relatively closed position when said hand crank is in the first lower position.

6. An exercise machine for simultaneously or separately exercising the muscles associated with moving the legs and the arms of an operator, comprising:

(a) a frame, (b) a fan mounted to the frame that includes an air filter for filtering air passing through said fan and a hamper for regulating air flow through said fan that moves between a relatively open position and a relatively closed position, (c) a pair of opposed foul pedals mounted to the frame for rotation relative to the frame, (d) a seat mounted to the frame positioned such that an operator sitting on the seat may power the foot pedals with his or her feet, (e) a hand crank assembly having a distal end and a proximate end and opposed hand cranks mounted to the distal end, said hand crank assembly pivotably mounted to said frame at its proximate end for pivoting between a first lower position and a second raised position, the first lower position characterized by placement of said hand crank assembly in a generally horizontal position such that said hand crank assembly is directed toward said seat such that said hand cranks are relatively lower and closer to said seat whereby a seated operator may more easily grasp the hand cranks, the second raised position characterized by placement of said hand crank assembly in an orientation directed away from said seat such that said hand crank is higher than when in the first position and more distant from said seat than when in the first position whereby said hand cranks are in a position suitable for grasping by a standing operator, whereby an operator may pivot said hand crank assembly between the first lower position and the second raised position when changing between a seated position and a standing position, said hand crank assembly operatively associated with said fan such that said hamper moves between said relatively open position and said relatively closed position when said hand crank assembly moves between said first lower position and said second raised position, (f) a drive train interconnecting the foot pedal assembly, the hand crank assembly and the fan so that the foot pedals and the hand cranks may turn in the same direction, at substantially the same rate and so that the operator can turn the rotating element of the resistance device by turning the foot pedals or by turning the hand cranks or by turning both the foot pedals and the hand cranks, whereby all of the muscles associated with movement of the legs and arms may be simultaneously exercised from either a seated position or a standing position.

7. The exercise machine of claim 6 wherein:

said hand crank assembly is operatively associated with said fan such that said hamper is in said relatively open position when said hand crank is in the second raised position and such that said hamper is in said relatively closed position when said hand crank is in the first lower position.

* * * * *